US009156305B2

(12) United States Patent
Sytema et al.

(10) Patent No.: US 9,156,305 B2
(45) Date of Patent: Oct. 13, 2015

(54) INSERTING SYSTEM AND A METHOD OF INSERTING ENCLOSURES IN ENVELOPES USING SAID INSERTING SYSTEM

(75) Inventors: Herman Sytema, Terherne (NL); Fransiscus Hermannus Feijen, Leeuwarden (NL)

(73) Assignee: NEOPOST TECHNOLOGIES, Bagneux (FR)

( * ) Notice: Subject to any disclaimer, the term of this patent is extended or adjusted under 35 U.S.C. 154(b) by 791 days.

(21) Appl. No.: 13/361,664

(22) Filed: Jan. 30, 2012

(65) Prior Publication Data

US 2012/0192529 A1 Aug. 2, 2012

(30) Foreign Application Priority Data

Jan. 31, 2011 (EP) ..... 11152768

(51) Int. Cl.

| | |
|---|---|
| ***B43M 3/02*** | (2006.01) |
| ***B65B 35/54*** | (2006.01) |
| ***B43M 3/04*** | (2006.01) |
| *B65B 35/30* | (2006.01) |

(52) U.S. Cl.

CPC ..... *B43M 3/02* (2013.01); *B43M 3/045* (2013.01); *B65B 35/54* (2013.01); *B65B 35/30* (2013.01)

(58) Field of Classification Search

USPC ..... 53/445, 460, 468, 474, 147, 154, 157, 53/247

See application file for complete search history.

(56) References Cited

U.S. PATENT DOCUMENTS

| | | | | |
|---|---|---|---|---|
| 3,797,196 | A * | 3/1974 | Harbison | 53/55 |
| 4,924,652 | A * | 5/1990 | Krasuski et al. | 53/55 |
| 4,939,888 | A * | 7/1990 | Katz et al. | 53/411 |
| 5,054,757 | A * | 10/1991 | Martin et al. | 270/45 |
| 5,080,340 | A * | 1/1992 | Hacknauer et al. | 270/37 |
| 5,263,708 | A * | 11/1993 | Hacknauer | 271/303 |
| 5,507,129 | A * | 4/1996 | Joson et al. | 53/55 |
| 5,701,727 | A * | 12/1997 | Lundstrom et al. | 53/569 |
| 6,016,638 | A * | 1/2000 | Bernard et al. | 53/117 |
| 6,132,554 | A * | 10/2000 | Traise et al. | 156/442.1 |
| 6,226,959 | B1 * | 5/2001 | Krasuski et al. | 53/117 |

(Continued)

FOREIGN PATENT DOCUMENTS

EP 1 016 549 A1 7/2000

OTHER PUBLICATIONS

European Search Report, dated May 20, 2011.

*Primary Examiner* — Christopher Harmon

(74) *Attorney, Agent, or Firm* — Seed IP Law Group LLC

(57) ABSTRACT

An inserting system has an envelope feeding station, an enclosure feeding station, and a folding station having a first and a second folding nip for folding documents. Documents are inserted into envelopes, which are held in an inserting position. Envelopes are transported through an envelope transport path from their feeding station to the inserting position, and enclosures are transported through an enclosure transport path from their feeding station to the inserting position. The enclosure transport path comprises a diverter, a first enclosure transport path part between the enclosure feeding station and the diverter and a second enclosure transport path part between the diverter and the inserting position. The second enclosure transport path part passes through the first and the second folding nip. A third enclosure transport path part is present between the diverter and the inserting position and bypasses the first folding nip and passes through the second folding nip.

9 Claims, 2 Drawing Sheets

(56) References Cited

U.S. PATENT DOCUMENTS 6,783,488 B1 8/2004 Shoebridge et al.
6,902,518 B2 * 6/2005 Bretl ..... 493/375
7,258,340 B2 * 8/2007 Clark et al. ..... 271/228
7,427,059 B2 * 9/2008 Lyga et al. ..... 270/58.06
7,934,357 B2 * 5/2011 Watson ..... 53/284.3
2006/0151934 A1 7/2006 Watson

* cited by examiner

INSERTING SYSTEM AND A METHOD OF INSERTING ENCLOSURES IN ENVELOPES USING SAID INSERTING SYSTEM

BACKGROUND OF THE INVENTION

The invention relates to an inserting system, comprising:

a document feeding station for feeding documents, an envelope feeding station for feeding envelopes, an enclosure feeding station for feeding enclosures, a folding station having a first pair of folding rollers forming a first folding nip there between and a second pair of folding rollers forming a second folding nip there between for folding documents, an inserting station for inserting documents into envelopes, said inserting station being connected to the folding station for receiving folded documents from the folding station, a document transport path for transporting documents from the document feeding station through the folding station to the inserting position, an envelope transport path for transporting envelopes from the envelope feeding station to the inserting position, and an enclosure transport path for transporting enclosures from the enclosure feeding station to the inserting position.

Such an inserting system is known from US-A1-2006/0220307. In this United States patent application an insertion system for inserting materials into envelopes to form mail pieces of a first type and mail pieces of a second type is described. This known insertion system comprises a folding subsystem for folding documents, said folding subsystem having a first pair of folding rollers forming a first folding nip there between and a second pair of folding rollers forming a second folding nip there between. In a path of travel of such materials from a feed station to an inserting position a diverter is present which can be activated either to send the materials through the folding subsystem or to bypass the folding subsystem.

In practice, a system as mentioned above is typically used in mailrooms where large numbers of documents or sets of documents are each to be inserted in an envelope in order to send these documents to addressees.

However, also in organizations that send relatively small numbers of documents, and where documents to be sent are for a considerable part processed by hand also when being prepared prior to insertion, mechanized insertion should lead to considerable saving of labor. To be considered here are, for instance, medical practices, workshops and club administrations, as well as service companies taking care of sending smaller mailings for third parties. In addition, in some organizations there is a desire to have several smaller inserting systems rather than one or a few larger ones. Accordingly, there is a need for inserting systems that are attractive due to smaller size than existing systems and involving relatively low cost, still being able to handle a wide variety of applications and having an attractive operation speed.

SUMMARY OF THE INVENTION

It is an object of the invention to provide a solution for enabling a more compact structure of an inserting system.

This object is achieved according to the invention by providing an inserting system, comprising:

a document feeding station for feeding documents, an envelope feeding station for feeding envelopes, an enclosure feeding station for feeding enclosures, a folding station having a first pair of folding rollers forming a first folding nip there between and a second pair of folding rollers forming a second folding nip there between for folding documents, an inserting station for inserting documents into envelopes, said inserting station being connected to the folding station for receiving folded documents from the folding station, a document transport path for transporting documents from the document feeding station through the folding station to the inserting position, an envelope transport path for transporting envelopes from the envelope feeding station to the inserting position, and an enclosure transport path for transporting enclosures from the enclosure feeding station to the inserting position, wherein the enclosure transport path comprises a diverter, a first enclosure transport path part between the enclosure feeding station and the diverter, a second enclosure transport path part between the diverter and the inserting position, said second enclosure transport path part passing through the first and the second folding nip, and a third enclosure transport path part between the diverter and the inserting position, said third transport path part bypassing the first folding nip and passing through the second folding nip. Preferably the diverter is operable to selectively divert enclosures to be transported from the enclosure feeding station to the inserting position by the first enclosure transport path part and the second enclosure transport path part or the first enclosure transport path part and the third enclosure transport path part. In this embodiment enclosures, such as cards or business reply envelopes, which are shorter than the length of one panel of the document which has been formed by folding, can selectively be transported to and collated in front of the first folding nip or the second folding nip. Enclosures for a C-(letter) or Z-folded document are preferably not nested inside the first fold, but in the second fold, to avoid disturbance of the first fold. When using window envelopes, one of the folds may need to be set shorter than the enclosure length in order to have the address in correct position behind the window. This is another reason why inserting in the second fold can be preferred. In some cases, especially when the enclosure is longer than the fold length, it is however necessary to fold the enclosure together with the documents, in order to fit in the envelope. In case of a single fold, where the second pair of folding rollers is not operative to effectuate a fold, the enclosure is preferably nested inside the first and only fold by sending the enclosure via the first folding nip. Thus the invention provides a relatively small inserting system which is able to handle a wide variety of applications.

A compact structure of the inserting system can be obtained when the envelope transport path and/or said third enclosure transport path pass through the second folding nip formed between the second pair of folding rollers. The orientation of the folding rollers can further be chosen in such a way that additional compactness can be obtained. When the first and second folding roller pair have one folding roller in common, an even further reduction in size and complexity is achieved. In this way only three folding rollers are needed to make the most common fold types. An even more compact structure can be obtained when the enclosure transport path and the envelope transport path have a substantial part in common.

Further embodiments disclosed in the dependent claims contribute to providing a simpler and more compact structure of an inserting system.

The invention also relates to a method of inserting enclosures in envelopes, in which method an inserting system as claimed in any one of the preceding claims is used, said inserting system comprising a control unit controlling the operation of the inserting system, said method comprising the step of automatically operating said diverter by said control unit to selectively divert enclosures either from the enclosure feeding station to the inserting position by the first enclosure transport path part and the second enclosure transport path part or from the enclosure feeding station to the inserting position by the first enclosure transport path part and the third enclosure transport path part. Preferably the step of automatically operating said diverter is based on one or more parameters chosen from the group consisting of fold length, fold type, length of a document, length of an envelope, and length, thickness or stiffness of an enclosure. Said fold length, length of a document, length of an envelope and/or length, thickness and/or stiffness of an enclosure can be advantageously measured automatically.

Further objects, aspects, effects and details of the invention are described in the following detailed description of a number of exemplary embodiments, with reference to the drawings.

DETAILED DESCRIPTION

Figure 1:
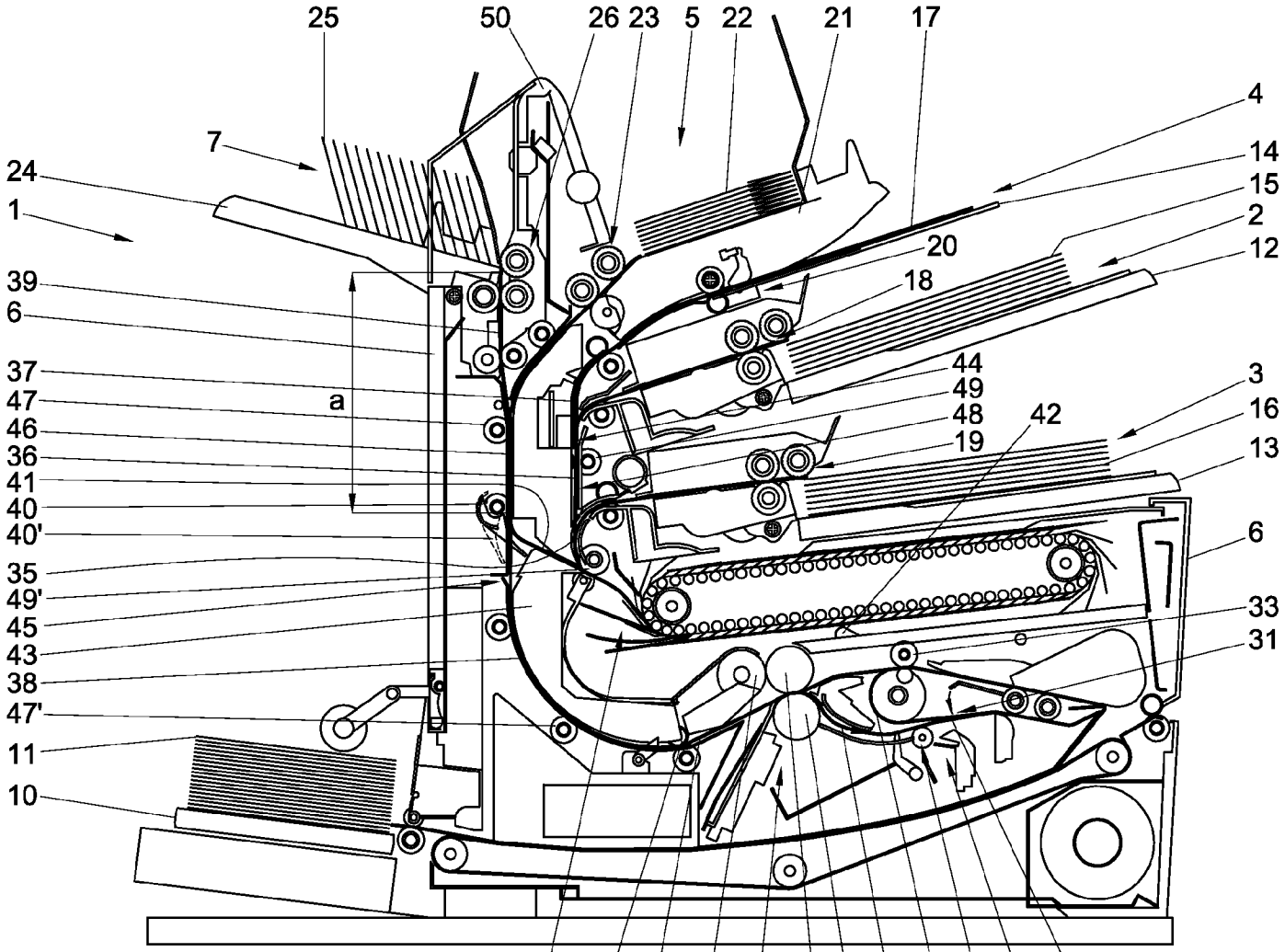
FIG. 1 is a schematic side elevation, partly in cross-section, of an inserting system according to the invention.

In FIG. 1 a schematic side elevation, partly in cross-section, of an inserting system 1 is shown. In this embodiment the inserting system 1 has a housing 6 in which three document feeding stations 2, 3, 4 for feeding documents, an envelope feeding station 5 for feeding envelopes, an enclosure feeding station 7 for feeding enclosures, a folding station 8, an inserting station 9 and a tray 10 for receiving completed mail pieces 11 can be distinguished.

Each document feeding station 2, 3, 4 has a document holder 12, 13, 14 for holding a stack 15, 16, 17 of documents and a separating system 18, 19, 20 for separating and transporting a document or document set from the stack 15, 16, 17 and transporting it further into the inserting system 1. In an embodiment, the feeding station 4 is dedicated to daily mail, in which case the whole stack (being one document set) is transported at once from the feeding station to a document transport path.

The envelope feeding station 5 and the enclosure feeding station 7 may both function as a feeder for sheetlike items, such as envelopes, enclosures, or documents. Hence it is possible to have two separate envelope feeders. In an alternative embodiment it is also possible to have e.g. two enclosure feeding stations, where the envelope feeding station is located elsewhere in the system (not shown in the drawings).

The envelope feeding station 5 has an envelope holder 21 for holding a stack 22 of envelopes and a separating system 23 for separating and transporting a single envelope from the stack 22 and transporting it further into the inserting system 1.

The enclosure feeding station 7 has an enclosure holder 24 for holding a stack 25 of enclosures and a separating system 26 for separating and transporting a single enclosure from the stack 25 and transporting it further into the inserting system 1.

The folding station 8 has a first pair of folding rollers 27, 28 forming a first folding nip there between and a second pair of folding rollers 28, 29 forming a second folding nip there between. In this embodiment one of the folding rollers of the first pair of folding rollers and one of the folding rollers of the second pair of folding rollers are formed by one and the same folding roller 28, but it is also possible that in an alternative embodiment the first and second pair of folding rollers do not comprise a common folding roller.

The inserting station 9 comprises an envelope holder 30 for holding an envelope 32 in an inserting position 31, and a flap hold-open element 33 for holding open a flap 34 of the envelope 32 held in the envelope holder 30. Please note that the envelope holder and the flap hold-open element are not depicted in detail, since these elements are known per se. For example, but not exclusively, the flap hold-open element and envelope holder as described in EP-A1-2.123.474 can be used in the inventive inserting system. In the situation where the flap 34 of the envelope 32 is held open by the flap hold-open element 33 a document folded in the folding station 8 can be inserted into the envelope 32. In order to realize this, the inserting station 9 is connected to the folding station 8 in a manner known per se.

From the document feeding station 3 a document transport path 35 for transporting documents from the stack 16 of documents extends through the folding station 8 to the inserting position 31. From the document feeding station 2 a document transport path 36 extends into the document transport path 35 for transporting documents from the stack 15 of documents through the folding station 8 to the inserting position 31. From the document feeding station 4 a document transport path 37 extends into the document transport path 36 for transporting documents, or a set of documents at once (in case the daily mail function is enabled or one of the feeding stations is dedicated to daily mail), from the stack 17 of documents through the folding station 8 to the inserting position 31.

From the envelope feeding station 5 an envelope transport path 38 for transporting an envelope from the stack 22 of envelopes extends through the second folding nip formed between the second pair of folding rollers 28, 29 to the inserting position 31.

From the enclosure feeding station 7 an enclosure transport path 39 enters into the envelope transport path 38 for transporting an enclosure from the stack 25 of enclosures through the second folding nip formed between the second pair of folding rollers 28, 29 to the inserting position 31. In this embodiment the enclosure transport path coincides at least for a part with the envelope transport path. However, in an alternative embodiment the enclosure transport path may be completely separate from the envelope transport path.

In the embodiment shown the enclosure transport path 38, 39 comprises a diverter 40. This diverter 40 defines a first enclosure transport path part a between the enclosure feeding station 7 and the diverter 40. In the position of the diverter 40 indicated by solid lines a second enclosure transport path part through which an enclosure can be transported is defined by a cross-over path 41 which runs into the document transport path 35. Thus the diverted enclosure passes through the first and the second folding nip, and is finally transported to the inserting position 31. In this position of the diverter 40 the enclosure transport path is formed by the first enclosure transport path part a, the cross-over path 41 and a (final) part of the document transport path 35. A stop 42 may be present to collate enclosures. Such a stop or other means for collating enclosures is known per se, and by way of non-limiting example reference is made to EP-A-2 107 021.

In the position of the diverter 40' indicated by dotted lines an enclosure being transported through the first enclosure transport path part a, continues through the envelope transport path 38 portion between the diverter 40' and the inserting position 31. This portion of the envelope transport path 38 between the diverter 40' and inserting position 31 forms a third transport path part for an enclosure bypassing the first folding nip and only passing through the second folding nip.

The diverter 40 is operable to selectively divert enclosures to be transported from the enclosure feeding station 7 to the inserting position 31 by the first enclosure transport path part a and the second enclosure transport path part (41 and final part of 35) or the first enclosure transport path part a and the third enclosure transport path part (portion of envelope transport path 38 between diverter 40 and inserting position 31).

Thus e.g. in case of a letter fold (also called a C-fold) or a Z-fold of the main documents and a relatively short enclosure or business reply envelope (BRE) fitting in the main envelope without being folded, the diverter 40' is placed in the position indicated by dotted lines and the enclosure or BRE will be sent through the third enclosure transport path part and bypasses the first folding nip. The enclosure is then inserted into the second fold of the documents, so that the enclosure or BRE will be nested inside the main documents and will not fall out of the envelope easily when the recipient opens the letter. In other cases the diverter 40 can be placed in the position indicated by the solid lines so that the enclosure or BRE passes through the first folding nip as well as the second folding nip (which folding stations form substations of the inserting system). This is mostly the case when a single fold is applied, in order to have the enclosure or BRE nested inside the main documents, but also applies to enclosures that need to be folded in order to fit into the envelope.

Although the diverter could be operated manually, it is presently most preferred to automatically operate said diverter to selectively divert enclosures either from the enclosure feeding station to the inserting position by the first enclosure transport path part and the second enclosure transport path part or from the enclosure feeding station to the inserting position by the first enclosure transport path part and the third enclosure transport path part. Such an automatic operation could be obtained based on one or more parameters chosen from the group consisting of fold length, fold type, length of a document, length of an envelope and length, thickness and stiffness of an enclosure. If e.g. for a specific type of mail pieces to be completed from a number or batch of sheetlike items these parameters are known beforehand, these parameters could be inputted in a control unit controlling the operation of the inserting system. Based on the inputted parameters said control unit is then able to place the diverter in the desired position. Alternatively the relevant parameters, such as fold length, length of a document, length of an envelope and/or length, thickness and/or stiffness of an enclosure could be measured automatically. For such measurements the inserting system comprises sensors or scanners or other means which are known per se. For example, fold lengths and fold type can be determined by measuring documents and envelopes as e.g. is described in EP-A-0498515 or EP-A-1084978. Please note that the position of the diverter may change from one set of documents to another.

The control unit could for example control the operation of the inserting system to determine automatically which way the enclosure should go based on the following algorithm:

IF enclosure length>(envelope length−insert margin)
OR fold type=single fold
THEN send enclosure to collator/first fold rollers
ELSE send enclosure to bypass/second fold rollers Thus, in case of a single fold, the diverter is placed in the position in which the enclosures are sent to the first folding nip if possible, because if the diverter would be positioned such that the enclosures would be sent via the second folding nip the enclosures would not be nested inside the folded documents and depending on the length of the enclosure and the envelope, the enclosure might not fit into the envelope.

Alternatively, the algorithm could also take other properties into account when determining which way the enclosure should go, e.g. the thickness of the enclosure:

IF (enclosure length>(envelope length−insert margin)
OR fold type=single fold)
AND enclosure thickness<1 mm
THEN send enclosure to collator/first fold rollers
ELSE send enclosure to bypass/second fold rollers This may be a useful addition, since the enclosure path bypassing the collating station and the first folding nip may be more suited to transport thicker (or more stiff) inserts.

In addition, also the composition of the set to be collated and folded may influence the choice to send an enclosure one way or the other, depending on the capacity of the collating unit and first folding unit. For instance, when the collator capacity is limited to five items, and this capacity is already reached for a document set excluding the enclosure, the enclosure will bypass the collator and the first fold, although the same enclosure would go to the collator and first folding rollers if there would be less then five documents to be collated and folded in that set.

It is obvious that an error notice can be made by the system, if the system is not capable of handling the combination of materials. In practice, an algorithm as mentioned in the examples here will be extended with the boundaries of the physical capacities of the system, and if these boundaries are crossed, an error notice or warning will be generated to the operator.

Optionally the control unit could be provided with an override input so that an operator can choose to overrule the automatic insert path selection.

As can be seen in FIG. 1 the envelope transport path 38 can be divided into a first envelope transport path part, which is arranged between the envelope feeding station 5 and the diverter 40 and a second envelope transport path part, which is arranged between the diverter 40 and the inserting position 31. To avoid too many paper paths and to be able to form a compact inserting system the paths are arranged such that a portion of the first envelope transport path part coincides with a portion of the first enclosure transport path part, and such that the second envelope transport path part and third enclosure transport path part coincide.

Seen in transport direction from a feeding station to the inserting position 31 the envelope transport path 38 and the document transport path 35 upstream of the second folding nip 28, 29 are separate so that documents and envelopes can be transported independently of each other and for example simultaneously thus increasing the output rate of the inserting system.

Figure 3:
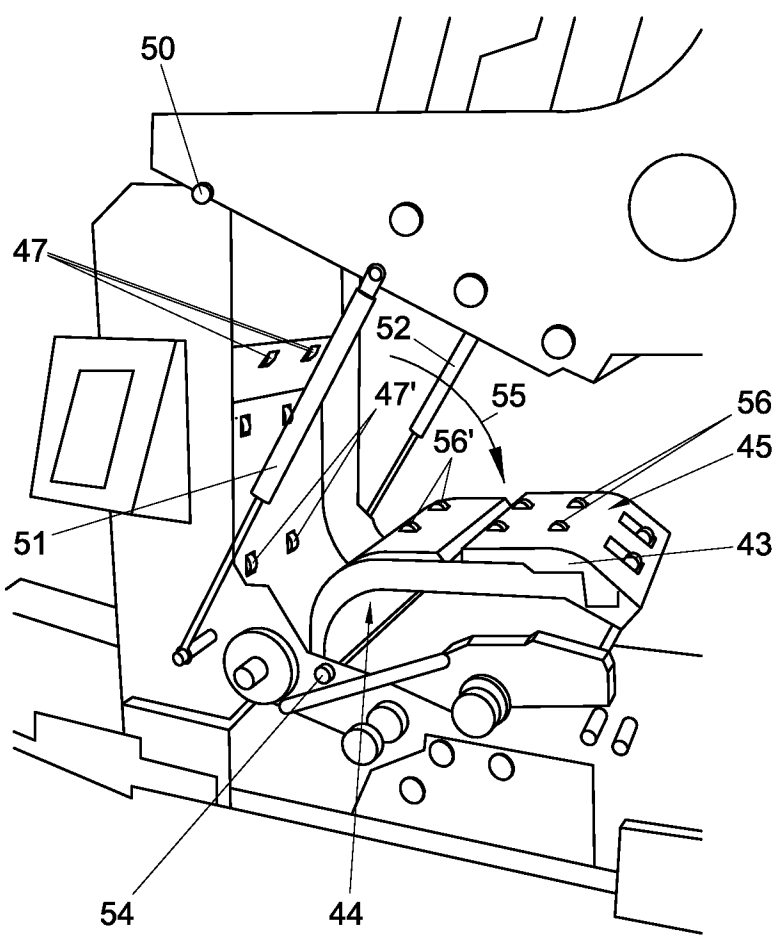
FIG. 3 is a schematic side view in perspective of the inserting system of FIGS. 1 and 2 in which the inserting system is further opened to access another paper transport path.
Figure 2:
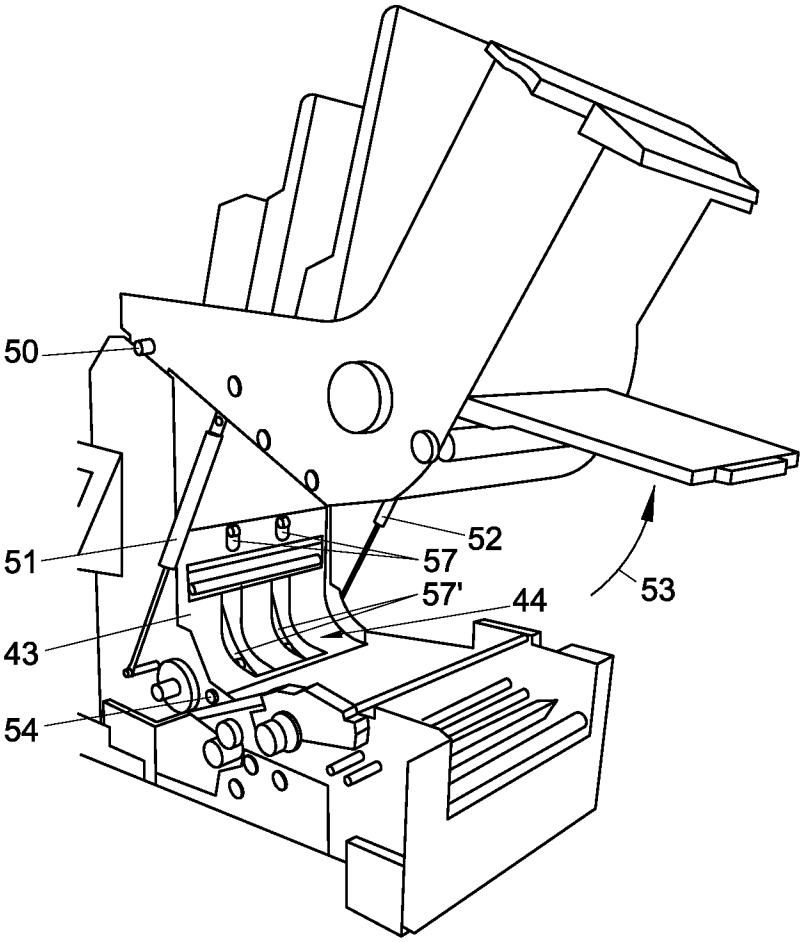
FIG. 2 is a schematic side view in perspective of the inserting system of FIG. 1 in which the inserting system is partly opened to access a paper transport path.

As can be seen in the embodiment shown in FIGS. 1-3 the inserting system 1 further comprises a plate 43 having a first side 45 and an opposite second side 44.

In the embodiment shown the envelope and enclosure transport path 38 is partly formed between a first paper item transport guide formed by the first side 45 of the plate 43 and a second paper item transport guide formed by a guide plate 46 and a number of transport rollers of which only two 47 and 47' are indicated in FIG. 1. The transport rollers 47, 47' in the first paper item transport guide are driving rollers which can be brought into contact with non-driving rollers 56, 56' (FIG. 3) arranged on the plate 43.

Furthermore in the embodiment shown the document transport path 35 is partly formed by the second side 44 of the plate 43 (forming a third paper item transport guide) and a fourth paper item transport guide formed by a guide plate 48 and a number of transport rollers of which only two 49 and 49' are indicated in FIG. 1. By this construction it is clear that, seen in transport direction from a feeding station to a substation (e.g. formed by a collating station, a folding station or an insert station), at least a portion of the first and second paper item transport guides 46, 45 and a portion of the third and fourth paper item transport guides 44, 48 upstream of the substation are separate. The rollers 49, 49' in the fourth paper item transport guide are driving rollers which can be brought into contact with non-driving rollers 57, 57' (FIG. 2) respectively, arranged on the plate 43.

Please note that although in this embodiment transport rollers are shown, the invention is not limited to rollers, but also encompasses other transport means such as belts, strings, a gripper mechanism or any other known transport mechanism or a combination of any other known transport means. The non-driving transport means (i.e. passive transport means) in the plate will rotate when they are in contact with the driving transport means. However, it is not necessary that the plate comprises non-driving transport means. It is also possible to provide the plate with a smooth guide plate, optionally provided with holes on the position of the driving transport means on the opposite side of the paper path.

Although the shown embodiment comprises guide plates 46, 48 the invention is not limited to the use of plates as guide elements. Furthermore, although in the shown embodiment transport rollers are shown, the invention is not limited to rollers. The guide plates and the transport rollers could also be replaced by other transport means such as belts, strings, a gripper mechanism or any other known transport mechanism or a combination of any other known transport means. For example, in an alternative embodiment the number of transport rollers 47, 47' could be sufficient to provide a guide for sheetlike items to be transported, so that the guide plate could be dispensed with. The non-driving transport means (i.e. the passive transport means) in the plate will rotate when they are in contact with the driving transport means. However, it is not necessary that the plate comprises non-driving transport means. It is also possible to provide the plate with a smooth guide plate, optionally provided with holes on the position of the driving transport means on the opposite side of the sheetlike item path. In case transport rollers, belts or strings are used the rotation axis of these transport means is perpendicular to the feeding direction of the sheetlike items.

In the embodiment shown the fourth paper item transport guide 48 together with amongst other things the document feeding stations, the envelope feeding station and part of the housing 6 are mounted in the inserting system so as to be rotatable around a first rotation axis 50, which is arranged near an upper side of the inserting system 1. As is shown in FIGS. 2 and 3 this upper part of the inserting machine can be rotated upward around the rotation axis 50 as indicated by the arrow 53. This part of the inserting machine is supported on opposite sides by e.g. hydraulic or pneumatic cylinders 51, 52. By such an upward rotation the fourth paper item transport guide 48 and the third paper item transport guide 44 are separated so that the document transport path is made accessible e.g. for maintenance or removal of jammed documents.

In addition the plate 43 is mounted in the inserting system 1 so as to be rotatable around a second rotation axis 54, which is arranged on a lower machine part near a lower side of the inserting system 1. The plate 43 can thus be rotated around the second rotation axis 54 in a second rotation direction (arrow 55). This causes that the second paper item transport guide 45 is rotated away from the first paper item transport guide 46 so that the envelope transport path is made accessible, e.g. for maintenance or removal of jammed envelopes or enclosures. For accessing the transport paths the rotation directions 53, 55 can be opposite.

In an alternative embodiment not shown in the Figures, the plate 43 could be mounted so as to be rotatable together with the upper machine part when this upper machine part is rotated upward around the rotation axis 50 as indicated by the arrow 53, so that the separation of the machine parts will take place between the first and second guides. In order to access the other paper path the plate 43 could then be mounted to the upper machine part so as to be rotatable around a rotation axis. Furthermore, the rotation axes could be positioned at approximately the same level of the machine. In a further alternative embodiment the plate could be mounted to the upper and lower machine part by other means than a rotation axis, such as a parallelogram construction or other construction forcing a more or less rectilinear movement of the plate relative to the machine part, as long as the plate can be moved away from the relative machine part to allow access to the relevant paper path. In addition the plate could be mounted in the inserting system so as to be completely removable from the upper and lower machine parts. Furthermore, the plate may be divided into two or more parts that may be opened together but also individually.

Although not indicated in the drawings the plate 43 can comprise sensors for paper detection and/or scanners for scanning a document transported through a transport path. These sensors and/or scanners can be movably mounted so that the sensors and/or scanners can be directed to either one of the transport paths. The diverter 40 can also be arranged on the plate 43, but can alternatively be arranged in or near the first paper item transport guide.

It will be clear that in case there are more separate transport paths in an inserting system more than one rotatable mounted plate without driving transport means separating these transport paths can be present. For example 4 parallel paper paths can be achieved using two plates in parallel. Although in the embodiment shown in FIG. 1 the holders 12, 13, 14 each hold a stack of documents, the holder 21 holds a stack of envelopes, and the holder 24 holds a stack of enclosures the invention is not limited to this embodiment. Depending on the desired application and configuration the holders may interchangeably hold other sheetlike items. In addition the inventive inserting system is not limited to the more or less vertical paper transport paths shown in the drawings but the invention is also applicable to inserting systems in which the paper paths are at least substantially horizontal.

The invention claimed is:

1. An inserting system, comprising:

a document feeding station for feeding documents, an envelope feeding station for feeding envelopes, an enclosure feeding station for feeding enclosures, a folding station having a first pair of folding rollers forming a first folding nip there between and a second pair of folding rollers forming a second folding nip there between for folding documents, an inserting station for inserting documents into envelopes, said inserting station being connected to the folding station for receiving folded documents from the folding station, a document transport path for transporting documents from the document feeding station through the folding station to the inserting position, an envelope transport path for transporting envelopes from the envelope feeding station to the inserting position, and an enclosure transport path for transporting enclosures from the enclosure feeding station to the inserting position, wherein the enclosure transport path comprises a diverter, a first enclosure transport path part between the enclosure feeding station and the diverter, a second enclosure transport path part between the diverter and the inserting position, said second enclosure transport path part passing through the first and the second folding nip, and a third enclosure transport path part between the diverter and the inserting position, said third transport path part bypassing the first folding nip and passing through the second folding nip, wherein the envelope transport path has a first envelope transport path part and a second envelope transport path part, said first envelope transport path part being arranged between the envelope feeding station and the diverter, the second envelope transport path part being arranged between the diverter and the inserting position, wherein a portion of the first envelope transport path part coincides with a portion of the first enclosure transport path part.

2. The inserting system according to claim 1, wherein said diverter is operable to selectively divert enclosures to be transported from the enclosure feeding station to the inserting position by the first enclosure transport path part and the second enclosure transport path part or the first enclosure transport path part and the third enclosure transport path part.

3. The inserting system as claimed in claim 1, wherein a portion of the second envelope transport path part and a portion of the third enclosure transport path part coincide.

4. The inserting system as claimed in claim 1, wherein seen in transport direction from a feeding station to the inserting position the envelope transport path and the document transport path upstream of the second folding nip are separate.

5. The inserting system as claimed in claim 1, wherein one of the folding rollers of the first pair of folding rollers and one of the folding rollers of the second pair of folding rollers are formed by one and the same folding roller.

6. The inserting system as claimed in claim 1, wherein the envelope transport path passes through the second folding nip formed between the second pair of folding rollers.

7. A method of inserting enclosures in envelopes, in which method the inserting system as claimed in claim 1 is used, said inserting system comprising a control unit controlling the operation of the inserting system, said method comprising the step of automatically operating said diverter by said control unit to selectively divert enclosures either from the enclosure feeding station to the inserting position by the first enclosure transport path part and the second enclosure transport path part or from the enclosure feeding station to the inserting position by the first enclosure transport path part and the third enclosure transport path part.

8. The method as claimed in claim 7, wherein the step of automatically operating said diverter is based on one or more parameters chosen from the group consisting of fold length, fold type, length of a document, length of an envelope and length of an enclosure.

9. The method as claimed in claim 8, wherein the fold length, the length of a document, the length of an envelope and/or the length, thickness and stiffness of an enclosure are measured automatically.

* * * * *